US007111745B2

(12) United States Patent
Nurse et al.

(10) Patent No.: US 7,111,745 B2
(45) Date of Patent: Sep. 26, 2006

(54) BOOM FOR A LOAD HANDLING MACHINE

(75) Inventors: Andrew David Nurse, Loughborough (GB); Richard Way, Stafford (GB); David Panni, Loughborough (GB); Paul Sherratt, Loughborough (GB)

(73) Assignee: J. C. Bamford Excavators Limited, Staffordshire (GB)

( * ) Notice: Subject to any disclaimer, the term of this patent is extended or adjusted under 35 U.S.C. 154(b) by 158 days.

(21) Appl. No.: 10/412,139

(22) Filed: Apr. 11, 2003

(65) Prior Publication Data

US 2003/0215319 A1 Nov. 20, 2003

(30) Foreign Application Priority Data

Apr. 12, 2002 (GB) ..... 0208446

(51) Int. Cl.
*B66C 23/697* (2006.01)

(52) U.S. Cl. ..... 212/350; 264/264; 414/718; 52/118; 52/731.2; 52/632

(58) Field of Classification Search ..... 52/117, 52/118, 111, 731.2, 632; 414/718; 212/264, 212/350

See application file for complete search history.

(56) References Cited

U.S. PATENT DOCUMENTS 3,378,978 A * 4/1968 Durand ..... 52/632
3,620,579 A * 11/1971 Brown et al. ..... 384/35
3,708,937 A * 1/1973 Sterner ..... 52/118
3,947,191 A * 3/1976 Milner, Jr. ..... 403/334
3,985,234 A * 10/1976 Jouffray ..... 212/350
3,997,695 A 12/1976 Gitt et al. ..... 428/36
4,016,688 A * 4/1977 Tiffin et al. ..... 52/118
4,112,649 A * 9/1978 Fritsch et al. ..... 52/732.1
4,171,598 A * 10/1979 Holmes ..... 52/118
4,216,895 A * 8/1980 Holmes ..... 228/178
4,257,201 A * 3/1981 Landolt et al. ..... 52/118
4,357,785 A * 11/1982 Eklund ..... 52/632
5,156,195 A * 10/1992 Wehler et al. ..... 160/202
5,158,189 A * 10/1992 Watson et al. ..... 212/350
5,238,716 A * 8/1993 Adachi ..... 428/34.7
5,556,677 A * 9/1996 Quigley et al. ..... 428/36.2
5,688,571 A * 11/1997 Quigley et al. ..... 428/36.1
5,829,606 A * 11/1998 Erdmann ..... 212/350
6,094,881 A * 8/2000 Lockwood ..... 52/731.2

(Continued)

FOREIGN PATENT DOCUMENTS

DE 2634081 2/1978

(Continued)

*Primary Examiner*—Robert Canfield
(74) *Attorney, Agent, or Firm*—MacMillan, Sobanski & Todd, LLC

(57) ABSTRACT

A boom for a load handling machine, the boom has a mounting by which the boom is mounted on a body of the machine, and at least first and second telescoped sections. In use, the boom carries a load handling implement at or towards its outermost end. The first boom section is telescoped within the second section and is extendible and retractable relative to the second boom section by an actuator. At least the first boom section includes walls made at least predominantly of a composite material. A bearing member is located where adjacent walls meet to extend along a substantial length of the first boom section to provide bearing surfaces during sliding of the first boom section relative to the second boom section. Bearings also may be provided on the interior of the second boom section to further protect the first boom section.

17 Claims, 3 Drawing Sheets

U.S. PATENT DOCUMENTS

| | | | | |
|---|---|---|---|---|
| 6,403,179 | B1 * | 6/2002 | Adachi | 428/36.3 |
| 6,481,587 | B1 * | 11/2002 | Higgins | 212/298 |
| 6,586,084 | B1 * | 7/2003 | Paschke et al. | 428/298.1 |
| 6,755,212 | B1 * | 6/2004 | Anderson et al. | 137/615 |
| 6,786,233 | B1 * | 9/2004 | Willner et al. | 137/615 |
| 2003/0215319 | A1 * | 11/2003 | Nurse et al. | 414/685 |
| 2003/0222784 | A1 * | 12/2003 | Nurse et al. | 340/685 |
| 2004/0145180 | A1 * | 7/2004 | Mayer et al. | 285/55 |
| 2005/0011560 | A1 * | 1/2005 | Anderson et al. | 137/615 |
| 2005/0011604 | A1 * | 1/2005 | Anderson et al. | 156/173 |

FOREIGN PATENT DOCUMENTS

| | | | |
|---|---|---|---|
| DE | 4328459 | | 5/1995 |
| DE | 197 56 746 | A1 * | 9/1998 |
| EP | 0117774 | | 9/1984 |
| EP | 0968955 | | 1/2000 |
| EP | 1 361 189 | A1 * | 11/2003 |
| GB | 2 006 158 | A * | 5/1979 |
| GB | 2 134 072 | A * | 8/1984 |
| GB | 2180909 | | 4/1987 |
| GB | 2207109 | | 1/1989 |
| GB | 2 387 375 | A * | 10/2003 |
| WO | 9626887 | | 9/1996 |

* cited by examiner

BOOM FOR A LOAD HANDLING MACHINE

CROSS-REFERENCE TO RELATED APPLICATIONS

Priority is claimed to United Kingdom patent application Serial No. 028446.5 filed Apr. 12, 2002.

STATEMENT REGARDING FEDERALLY SPONSORED RESEARCH OR DEVELOPMENT

Not Applicable.

TECHNICAL FIELD

The invention relates to a boom for a load handling machine, and more particularly to a boom which includes a plurality of telescoped sections.

BACKGROUND OF THE INVENTION

The invention relates to a boom for a load handling machine, and more particularly to a boom which includes a plurality of telescoped sections. A load handling implement such as a bucket or loading forks, for examples, is carried at an outermost end of the boom. The boom is mounted at an innermost end on a body of the machine. In one example, the boom for the load handling machine is pivotal about a mounting axis which is generally horizontal, with the boom extending alongside and forwardly of an operator's cab on the machine. The machine is movable over the ground on a ground engaging structure such as wheels carried on axles.

The boom conventionally is made of metal so as to be sufficiently strong to handle heavy loads. It will be appreciated that when the boom is fully extended, the load handled by the load handling implement exerts a substantial tipping moment about a front axle of such a machine. Regardless of the strength of the boom, there is a restriction on the load which can be handled. Moreover the weight of the conventionally metal boom is not an insignificant factor when determining a maximum safe load, as the weight of the boom will contribute to the tipping moment, particularly when extended fully.

BRIEF SUMMARY OF THE INVENTION

According to a first aspect of the invention, a boom for a load handling machine is mounted on a body of the machine. The boom includes first and second telescoped sections. In use, the boom carries a load handling implement at or towards its outermost end. The second boom section is telescoped within the first section and is extendible and retractable relative to the first boom section by an actuating means. At least one of the boom sections includes a plurality of walls, each including a web made at least predominantly of a composite material. Bearing members extend along a substantial length of the boom section where adjacent walls meet to provide bearing surfaces during sliding of the second boom section relative to the first boom section.

The bearing members may be made of any hard wear-resistant material such as metal, or a suitable polymeric. By extending along the composite boom section, the bearing members provide wear-resistant bearing surfaces to facilitate telescoping the boom section and/or to provide wear-resistant surfaces to facilitate the use of wear pads. In one example, the first boom section includes the mounting and may be made of metal or a composite material, and the walls of the second boom section may be made at least predominantly of a composite material.

Thus the first, innermost boom section which has the mounting for mounting the boom on the body of the machine, and which needs to be sufficiently strong both to support the load and each other boom section, can be made of metal. At least the outermost second boom section which makes the greater contribution to the tipping moment when the boom is extended and may not support any further boom section, is made of a lighter composite material. The boom may include at least one further boom section telescoped within the second boom section. Preferably, such further section or sections are made with walls predominantly of a composite material, especially those sections which extend the furthest from the first, innermost section. Preferably each of the boom sections is hollow, with an actuating means for extending and retracting the second boom section relative to the first boom section provided in the hollow of the first and/or second boom sections.

The bearing members, where provided on the second boom section may be provided on the exterior of the boom section. Where a further telescoped section is provided which slides in the second boom section, bearing members also may be provided interior to the section to provide bearing surfaces as the further boom section slides. Where the bearing members are provided on the first boom section, the bearing members may be provided in the interior of the boom section.

Each of the bearing members may be right-angled strips which overlap respectively the webs of the adjacent walls. The bearing members may be bonded to the composite material, and/or affixed by fasteners, or even located and affixed during molding of the composite material in positions subject to wear or potentially subject to impact damage. Where the bearing members are described herein as being on a boom section, the term "on" is intended to include on the surface of the section of partially and/or embedded in the walls of the boom section.

In an alternative arrangement, the second boom section may be generally rectangular in cross section, including a top wall and a bottom wall and side walls between the top and the bottom walls, each side wall being joined to the top and bottom walls by the bearing members. For example, each bearing member may include a groove to receive a side wall and a groove to receive a respective top or bottom wall. These bearing member can provide bearing surfaces both as the second boom section slides relative to the first boom section, and as a further boom section slides relative to the second boom section.

The bearing members may provide support for boom fittings such as a mounting for an actuating means. The bearing members may also provide mountings for wear pads which conventionally are provided between relatively sliding boom sections.

The composite material may be a fiber matrix of for example, glass and/or carbon and/or aramid fibers, in a resin, such as epoxy, polyester or vinyl esters. The fibers of the matrix may be aligned along and/or around the boom section for optimal strength.

According to a second aspect of the invention we provide a section of a boom of the first aspect of the invention, the section including a plurality of walls each including a web made at least predominantly of a composite material. Bearing members are provided where adjacent walls meet to extend along a substantial length of the boom section to provide bearing surfaces during sliding of the boom section relative to another boom section.

Various objects and advantages of the invention will become apparent from the following detailed description of the invention and the accompanying drawings.

DETAILED DESCRIPTION OF THE INVENTION

Figure 1:
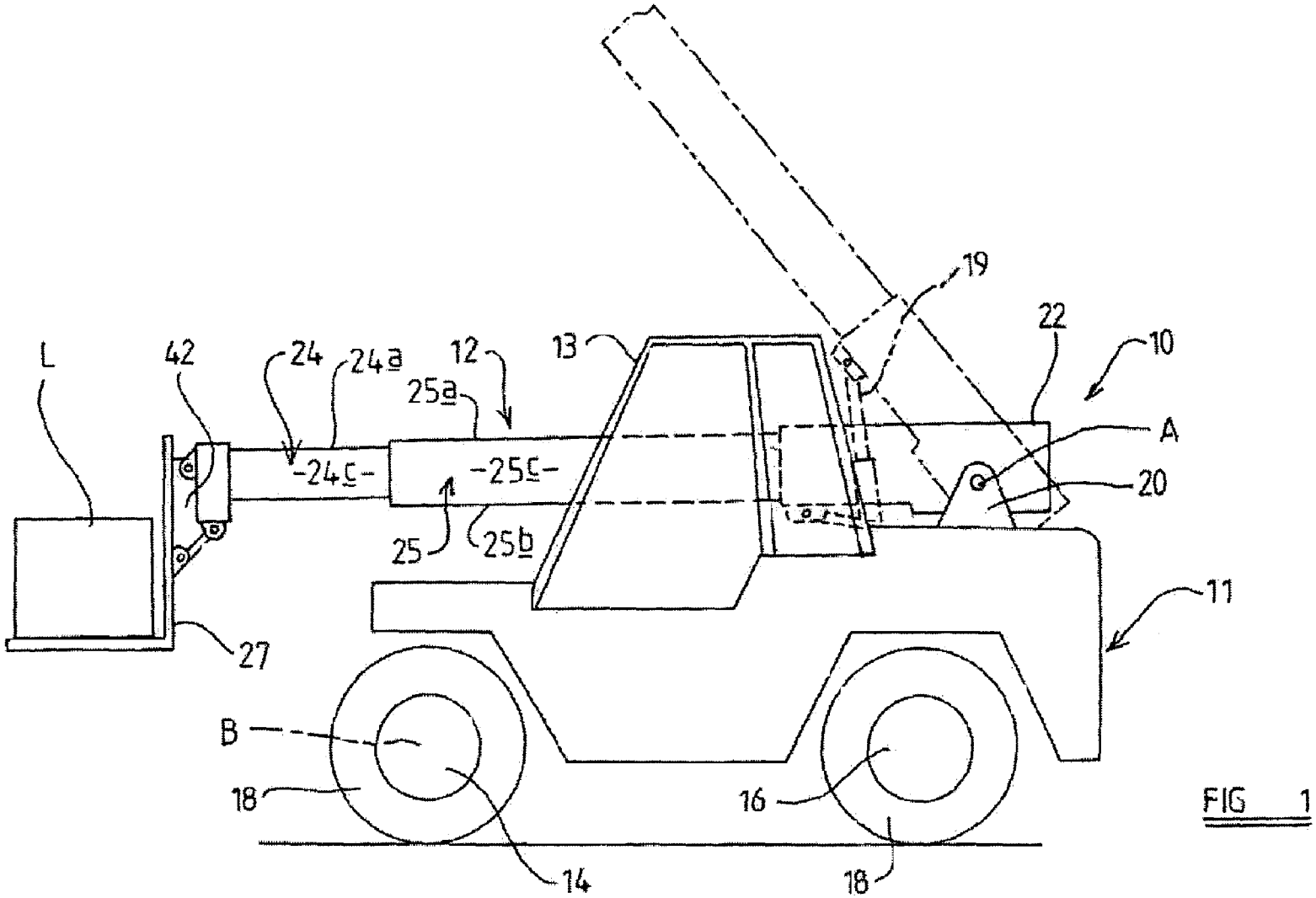
FIG. 1 is an side elevational view of an exemplary load handling machine having a boom in accordance with the invention.

Referring to the drawings, an exemplary load handling machine 10 includes a body 11 which has an operator's cab 13 at one side thereof, and a boom 12 at another side. The boom 12 is mounted on the body 11 for pivotal movement about a generally horizontal boom mounting axis A behind the cab 13. The boom 12 extends forwardly from the mounting axis A alongside the cab 13 and forwardly of the cab 13 and the body 11. The body 11 of the machine is provided with a ground engaging structure which in this example includes a front axle 14, and a rear axle 16, with each axle 14, 16 carrying wheels 18.

The boom 12 is mounted on the body 11 for pivotal movement about the axis A, at a mounting 20. In this example, the mounting 20 is rearwardly of the cab 13. A first hydraulic actuator 19, in this example, acts between the body 11 and boom 12 to raise and lower the boom 12 relative to the body 11.

The boom 12 on the machine 10 of FIG. 1 is a three section boom 12. The exemplary boom 12 includes an innermost section 22 which is mounted on the body 12, an outermost boom section 24 which carries a load handling implement 27 (e.g. loading forks) at or towards its outermost end, and an intermediate boom section 25. The three sections 22, 24 and 25 are telescopic, as hereinafter described, so that the boom 12 is extendible and retractable to move the load handling implement 27 towards and away from the body 11. In FIG. 1 the boom 12 is shown in full lines at a typical low position, with the boom partially 12 retracted. The boom 12 may be lowered by the actuator 19 further than shown, and may be further retracted. In dotted lines, a part of the boom 12 is shown in a raised position with the boom 12 fully extended.

It will be appreciated than in the dotted line position, with a full load L on the load handling implement 27, there will be a tipping moment about an axis B of the front axle 14 which tends to tip the machine 10 about the wheel axis B. Regardless of the strength of the boom 12, there is a restriction on the load L which can be handled which varies with boom extension, height and weight.

The innermost boom section 22 may be made of metal or a suitably strong composite material, and supports not only the load L, but the intermediate boom section 25 and the outermost boom section 24, too. The intermediate boom section 25 and outermost boom section 24 are however made predominantly of a lighter composite material, namely, a material which is a matrix of fibers in a resin. The composite material may be a fiber matrix of for example, glass and/or carbon and/or aramid fibers, in a resin, such as epoxy, polyester or vinyl esters. The fibers of the matrix may be aligned along and/or around the boom sections 24, 25 for optimal strength.

It can be seen that the outermost composite boom section 24 is in this example of generally rectangular cross section and having a top wall 24*a*, a bottom wall 24*b*, and a pair of side walls 24*c*, 24*d* in the form of webs which define an internal hollow H. However the boom section 24 may be of other configurations, as hereinafter described.

The cross section of the outermost boom section 24 is smaller than that of the intermediate section 25 which also is of generally rectangular hollow cross section having a top wall 25*a*, a bottom wall 25*b* and side walls 25*c*, 25*d* in the form of webs, and the outermost boom section 24 is received in telescoped fashion, within the hollow H of the intermediate boom section 25. The outermost boom section 24 slides in and out relative to the intermediate boom section 25, by an actuator, e.g. a hydraulic actuator which is mounted within the hollow H of at least the intermediate boom section 25, and is secured to the outermost second boom section 24.

It will be appreciated that the outermost boom section 24, being made of a composite material, is susceptible to wear as the section 24 slides in and out of the intermediate boom section 25. Likewise, the intermediate boom section 25 is susceptible to wear both as the outermost section 24 slides in and out, and as the section 25 slides in and out of the innermost boom section 22.

Wear pads 28 (see FIG. 3) may be provided at the four external corners of the outermost boom section 24 or elsewhere, at an innermost end 29 of the section 24, as is conventional in the art. However, wear may occur where the corners of the outermost boom section 24 and the top and side walls 24*a*, 24*c*/24*d* and bottom side walls 24*b*, 24*c*/24*d* meet and may well rub on internal surfaces of the intermediate boom section 25 during relative sliding. Furthermore, when the outermost boom section 24 is loaded, the problem of wear of the composite material of the boom section 24 particularly at the corners will be exacerbated.

According to the invention, elongate bearing members 30 are provided at each of the external corners of the outermost boom section 24, the members 30 in this example extending over a substantial portion of the length of the boom section 24. The bearing members 30 are made from a suitably hard material, such as for examples of steel or another metal, or of a hard plastic material such as nylon. The bearing members 30 in this example are formed to be angle strips, which extend over and overlap a part of the webs at the top wall 24*a* or bottom wall 24*b*, and a part of a respective side wall 24*c* or 24*d*, to protect the corners of the second boom section 24 during sliding of the outermost boom section 24 within the intermediate boom section 25.

Figure 2:
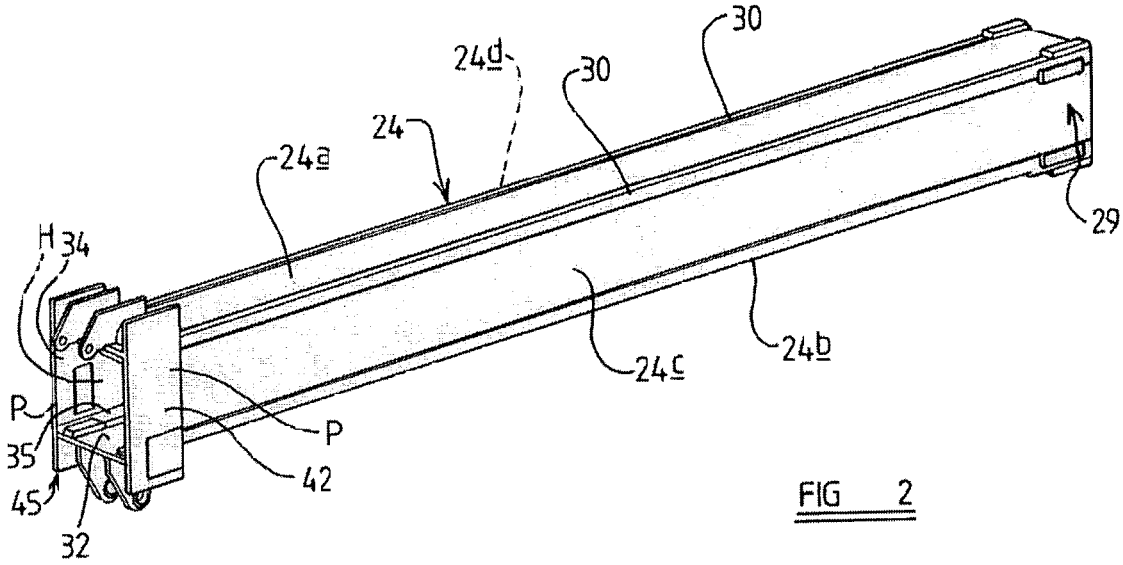
FIG. 2 is a perspective view from a side of an outermost section of the boom of the machine of FIG. 1.
Figure 3:
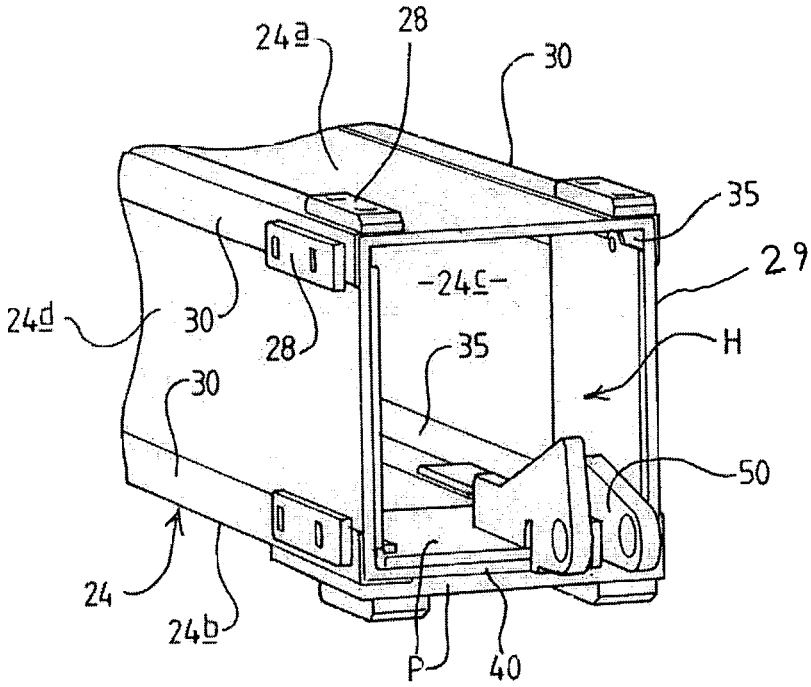
FIG. 3 is an enlarged end view of the boom section of FIG. 2.
Figure 4:
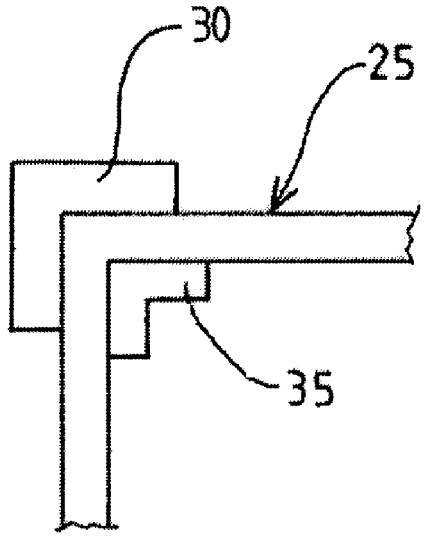
FIG. 4 is an enlarged fragmentary view of a part of a boom section in accordance with invention, showing one construction.

The intermediate boom section 25 may be made of metal or composite material as desired. To provide minimum weight, and thus increase the load which the machine 12 can handle, it is preferable that the intermediate boom section 25 is also made of a composite material. To protect the intermediate boom section 25 from wear as the outermost boom section 24 slides in and out of the intermediate boom section 25, the intermediate boom section 25 may be provided with interior bearing members 35. The bearing members 35 are of angle section and made of metal or at least of a material harder than the composite material of the webs of the walls 25*a*, 25*b*, 25*c*, 25*d*. For the purposes of illustration the outermost boom section 24 shown in FIGS. 2 and 3, is shown provided with such interior bearing members 35 although these would not be required for providing wear resistance as no further boom section slides inside the outermost boom section 24. However, these may be provided for other purposes too, as hereinafter described. In FIG. 4, an end view of the intermediate boom section 25 shows the exterior 30 and interior 35 bearing members.

The innermost boom section 22 is also generally rectangular in this example, dimensioned so as to receive in telescopic fashion therein, the intermediate boom section 25. Thus the exterior corners of the intermediate boom section 25 where the respective top and side walls 25*a*, 25*c*/25*d* and bottom and side walls 25*b*, 25*c*/25*d* may be provided with bearing members 30, to give wear protection as the intermediate boom section 25 slides in and out of the innermost boom section 22.

In each case the bearing members 30, 35 may be fixed to the composite material either by bonding with a suitable bonding agent, and/or fasteners, which where interior 35 and exterior 30 bearing members are provided may pass through the composite material and be fixed to the bearing members 30, 35 so as to sandwich the composite material of the webs of the walls between the bearing members 30, 35. Alternatively or additionally to either of those methods, the bearing members 30, 35 may be laid up with the composite material of the or the respective intermediate 25 and outermost 24 boom sections when the boom section(s) is/are made, the bearing members 30, 35 having formations which become integrated with the composite material and thus affixed relative thereto during molding. In each of these embodiments, the bearing members 30, 35 are considered to be "on" the boom section.

It will be appreciated that in use, the bearing members 30, 35 help to transmit forces experienced primarily in the webs of the top walls 24*a*, 25*a* and bottom walls 24*b*, 25*b* of the rectangular boom section 24 (and 25), to the side walls 24*c*/24*d*, and 25*c*/25*d* and thus distribute loads over the whole boom 12 structure.

If desired, additional bearing members may be provided elsewhere on the outermost boom section 24 and/or on the intermediate boom section 25 where wear is likely to be experienced. These additional strips, and the exterior bearing members 30 and interior bearing members 35 where provided, as well as providing wear protection, may perform other functions.

It will be appreciated that composite material is more prone than metal to becoming damaged from, for example, as a result of impact. Moreover, whereas a metal section would visibly dent, damage of a composite section can be invisible to the naked eye, as such impacts may result in internal disruption of the structure only. The exterior bearing members 30 at least, being made of harder material than the composite material of the outermost and/or intermediate boom section 25 will afford the composite material protection against impact damage at the corners of the boom section 25 which are perhaps most prone to such impact damage.

The bearing members 30, 35 also provide surfaces for the attachment of fittings to the composite boom sections 24, 25, such as for examples only, actuator mountings. An exemplary actuator mounting 40 is shown in FIG. 4 at the inner end 29 of the boom section 24, and/or the load handling implement 27 mounting 42. Such mountings may include plates P which span the respective top 31, bottom 32 and side webs 33, 34 so as to be connectable to at least two bearing members 30, 35.

In the FIG. 2 view, it can be seen that the loading implement 27 mounting 42 is generally rectangular in cross section and extends around the exterior of the boom section 24 at an outermost end 45 thereof, interconnecting with all four exterior bearing members 30.

In the FIG. 3 view, at the innermost end 29 of the boom section 24, the actuator mounting 50 has plates P which extend interiorly and exteriorly of the bottom web 32 of the boom section 24, sandwiching the composite material therebetween, each interior and exterior plate P interconnecting respectively, the two lower bearing members 35, 30. Wear pads 28 at the innermost end 29 of the boom section 24 are also attached to the bearing members 30. It will be appreciated that bearing members 30, 35 of other configurations may be provided, particularly where the boom 12 is of another configuration. For example, the composite boom section or sections 24, 25, and even the metal boom section 22 may be other than rectangular cross sectional configuration as described and thus may have any plurality of walls with bearing members provided where adjacent walls meet.

If desired, the innermost first boom section 22 may be made of a composite material. Whereas such a composite innermost first boom section 22 may require interior bearing members only to provide wear protection as the intermediate boom section 25 slides in and out, exterior strips may be provided to facilitate providing the mounting 20 at mounting axis A, and/or a mounting for the actuator 19 which raises and lowers the boom 12.

In the examples described, the bearing members 30, 35 extend along the respective boom sections 22, 24, 25 preferably from end to end. If desired the bearing members may extend along a substantial part of the length only, for example in a region where bearing support for the composite material is desired. For one example only, the exterior and interior bearing members 30, 35 for the outermost boom section 24 may be provided locally of the respective end of the boom section 24 only, to provide support for the loading implement mounting or the actuator mounting in those regions only.

Figure 5:
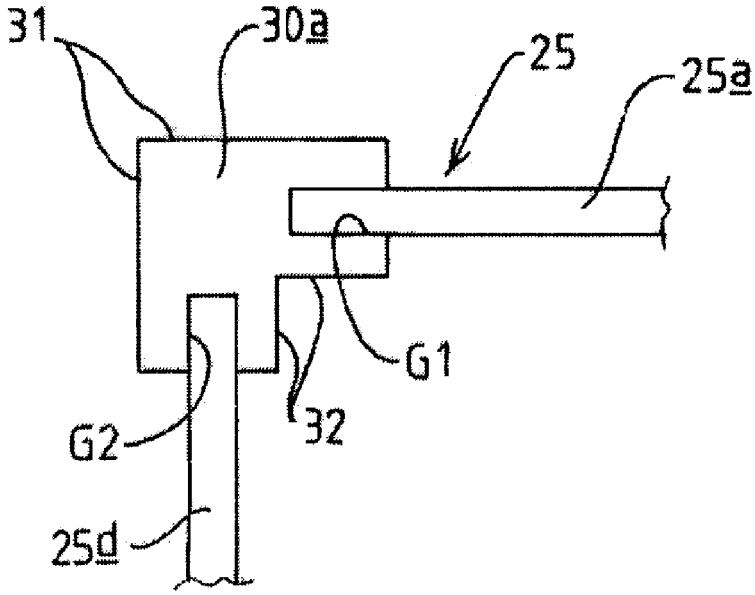
FIG. 5 is a view similar to FIG. 4 but of an alternative embodiment.

Referring now to FIG. 5 an alternative construction is illustrated for the intermediate boom section 25. In this example, an interior bearing member 35 and an exterior bearing member 30 are integrally provided by a metal bearing member 30*a* which also serves to join the composite webs of the walls 25*a*, 25*b*, 25*c*, 25*d*, of the boom section 25. The bearing member 30*a* has a groove G1 to receive an edge of the web of the top wall 25*a*, and a groove G2 to receive the edge of the web of one side wall 25*d*. The webs are secured in their grooves G1, G2 either as the composite material of the boom section 25 is molded, or may be adhered in position or otherwise secured subsequent to the composite webs 25*a*, 25*b*, 25*c*, 25*d* being made.

The bearing member 30*a* provides exterior bearing surfaces 31 which protect the composite material as the intermediate boom section 25 slides in and out of the innermost boom section 25, and interior bearing surfaces 32 which protect the composite material as the outermost boom section 24 is slid in and out of the intermediate boom section 25. The bearing member 30*a* could of course be made of an other material and to other configurations to join the adjacent walls and provide both interior and exterior bearing surfaces. For example, the bearing members 30*a* could provide round corners to the boom section (S) in which case the bearing members 30*a* would provide a single interior/exterior rounded bearing surface. Where no further boom section 24 is provided, the bearing member 30*a* may only provide exterior bearing surfaces 31.

It will be appreciated that whereas the invention has been described in relation to a machine 10 having a three section boom 12, if desired the boom may have only two sections, or more than one intermediate section.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

The invention claimed is:

1. A boom for a load handling machine, at least first and second telescoped sections, said boom being adapted to carry a load handling implement in use at or towards an outermost end of said first boom section, said first boom section telescoping within said second boom section wherein said first boom section is extendible and retractable relative to said second boom section, at least one of said boom sections includes a plurality of walls including a web made at least predominantly of a composite material, and bearing members where adjacent walls meet which extend along a substantial length of the boom section to provide bearing surfaces during sliding of said first boom section relative to said second boom section, wherein walls of said first boom section are made at least predominately of said composite material, and wherein walls of said second boom section are made of metal.

2. A boom according to claim 1 wherein said boom includes at least a third boom section, and wherein said second boom sections telescopes within said third boom section.

3. A boom according to claim 1 wherein said first boom section includes bearing members which are provided on the exterior of said first boom section.

4. A boom according to claim 3 wherein said boom includes a third boom section, wherein said second boom section telescopes within said third boom section, wherein bearing members are provided on the exterior of said second boom section to provide bearing surfaces as said second boom section slides relative to said third boom section, and wherein bearing members are provided on the interior of said second boom section to provide bearing surfaces as said first boom section slides relative to said second boom section.

5. A boom according to claim 1 wherein said second boom section includes bearing members which are provided on the interior of said second boom section.

6. A boom according to claim 1 wherein each of said bearing members is a right-angled strip which overlaps respectively the webs of the adjacent walls.

7. A boom according to claim 6 wherein said bearing members are bonded to the composite material.

8. A boom according to claim 6 wherein said bearing members are affixed by fasteners.

9. A boom according to claim 6 wherein said bearing members are located and affixed during molding of said composite material.

10. A boom according to claim 1 wherein said second boom section is generally rectangular in cross section, including a top wall and a bottom wall and side walls between said top and said bottom walls, and wherein each side wall is joined to said top and bottom walls by bearing members.

11. A boom according to claim 1 wherein said bearing members provide support for a boom fitting.

12. A boom according to claim 1 wherein said composite material is a fiber matrix selected from the group consisting of glass fibers, carbon fibers and aramid fibers, embedded in a material selected from the group consisting of an epoxy, a polyester and a vinyl ester resin.

13. A boom according to claim 12 wherein said fibers of said matrix are aligned along and/or around the boom section for optimal strength.

14. A boom for a load handling machine, at least first and second telescoped sections, said second section having a generally rectangular cross section, including a top wall, a bottom wall and side walls between said top and bottom walls and wherein each side wall is joined to said top and bottom walls by bearing members, said boom being adapted to carry a load handling implement in use at or towards an outermost end of said first boom section said first boom section telescoping within said second boom section wherein said first boom section is extendible and retractable relative to said second boom section, at least one of said boom sections includes a plurality of walls including a web made at least predominantly of a composite material, and bearing members where adjacent walls meet which extend along a substantial length of the boom section to provide bearing surfaces during sliding of said first boom section relative to said second boom section, and wherein said boom includes at least a third boom section, wherein said second boom section is telescoped within said third boom section, wherein each bearing member includes a groove to receive a side wall and a groove to receive a respective top or bottom wall, and wherein said bearing members provide bearing surfaces both as said first boom section slides relative to said second boom section and as said second boom section slides relative to said third boom section.

15. A boom according to claim 14 wherein walls of said first boom section are made at least predominantly of said composite material.

16. A boom according to claim 14 wherein each of said boom sections is hollow, and an actuating means for extending and retracting said first boom section relative to said second boom section is provided in the hollows of at least one of said boom sections.

17. A boom for a load handling machine, the boom having a mounting by which the boom is mounted on a body of the machine and at least first and second telescoped sections, said boom being adapted to carry a load handling implement in use at or towards an outermost end of said first boom section, said first boom section telescoping within said second boom section wherein said first boom section is extendible and retractable relative to said second boom section, and wherein at least one of said boom sections includes top, bottom and side walls, each wall including a web made at least predominantly of a composite material, and a bearing member where each two adjacent walls meet which extends along a substantial length of the boom section to provide bearing surfaces for both of the adjacent walls during sliding of said first boom section relative to said second boom section, and wherein the bearing members extend over parts of the webs of the adjacent walls to distribute loads experienced in the webs of the top and bottom walls over the boom section structure.

* * * * *